United States Patent [19]

Henkin et al.

[11] Patent Number: 4,679,258

[45] Date of Patent: Jul. 14, 1987

[54] HYDROTHERAPY MASSAGE METHOD AND APPARATUS

[76] Inventors: Melvyn L. Henkin, 5011 Donna Ave., Tarzana, Calif. 91356; Jordan M. Laby, 3038 Bayshore, Ventura, Calif. 93001

[21] Appl. No.: 843,151

[22] Filed: Mar. 24, 1986

Related U.S. Application Data

[63] Continuation-in-part of Ser. No. 796,987, Nov. 12, 1985.

[51] Int. Cl.[4] ..... A61H 33/02

[52] U.S. Cl. ..... 4/542; 4/541; 4/544; 4/492; 128/66; 239/416.4; 239/416.5

[58] Field of Search ..... 4/541, 542, 492, 543–544, 4/491; 128/66; 239/428.5, 587, 429, 416.5, 413, 416, 416.4

[56] References Cited

U.S. PATENT DOCUMENTS

| | | | |
|---|---|---|---|
| 4,220,145 | 9/1980 | Stamp et al. | 4/542 |
| 4,335,854 | 6/1982 | Reynoso | 4/542 X |
| 4,339,833 | 7/1982 | Mandell | 4/542 |
| 4,466,141 | 8/1984 | Starkey | 4/542 X |
| 4,520,514 | 6/1985 | Johnson | 4/542 X |
| 4,523,340 | 6/1985 | Watkins | 4/542 |

*Primary Examiner*—Henry K. Artis

*Attorney, Agent, or Firm*—Freilich, Hornbaker, Rósen & Fernandez

[57] ABSTRACT

A hydrotherapy method and apparatus for discharging a fluid stream through an opening in the wall of a water tub, while concurrently translating the stream along a random path, to impact against the massage the body of a user.

39 Claims, 23 Drawing Figures

Fig. 6
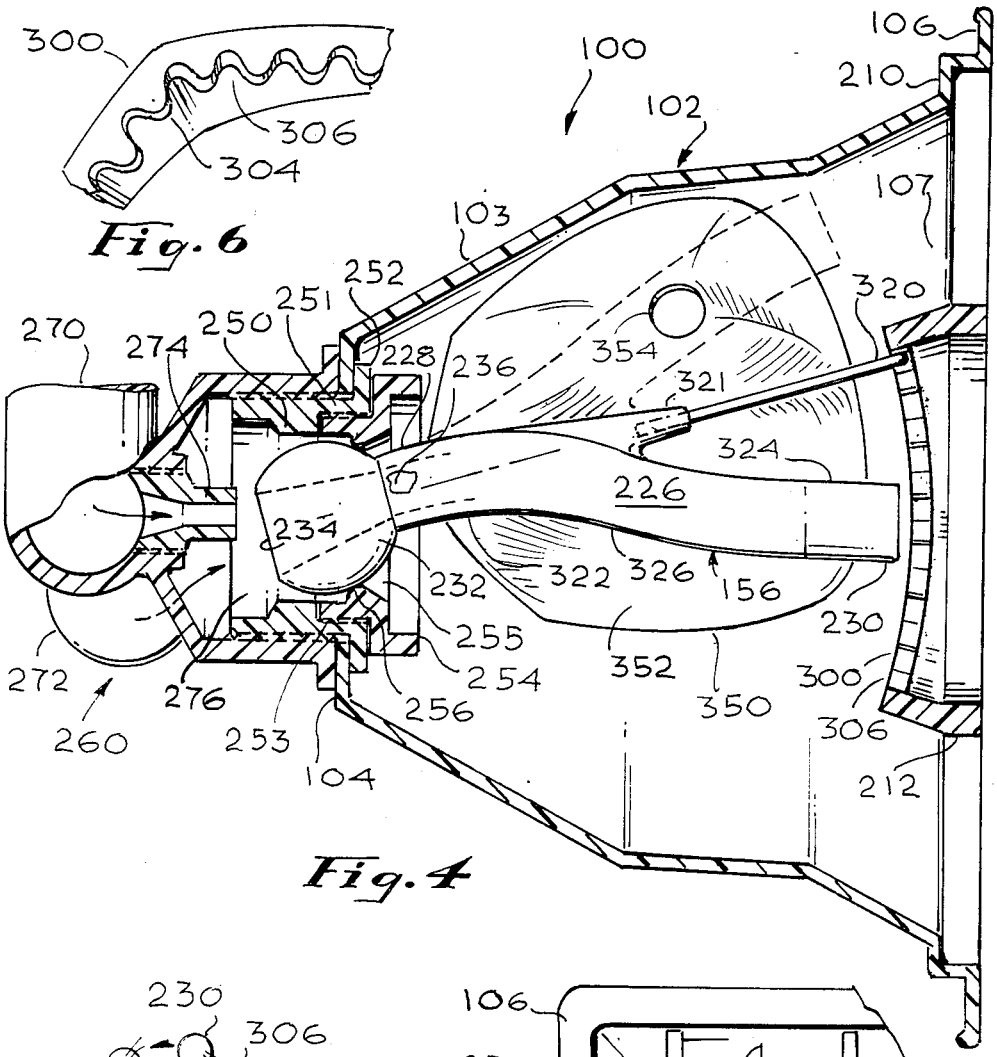
Fig. 4
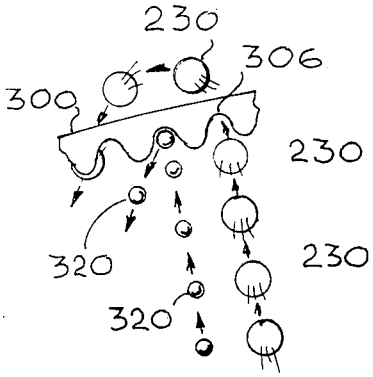
Fig. 9
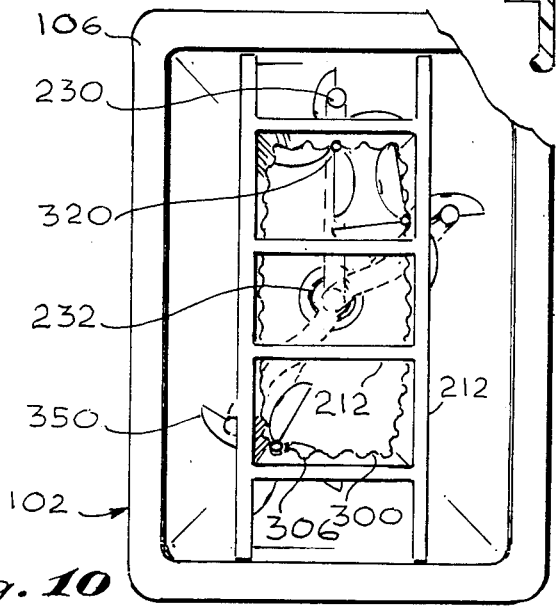
Fig. 10

HYDROTHERAPY MASSAGE METHOD AND APPARATUS

RELATED APPLICATIONS

This is a continuation-in-part of Application Ser. No. 796,987 filed Nov. 12, 1985, whose disclosure is, by reference, incorporated, herein.

BACKGROUND OF THE INVENTION

This invention relates generally to hydrotherapy and more particularly to an improved method and apparatus useful in spas, hot tub, bathtub, and the like for discharging a fluid (e.g.water-air) stream to impact against and massage a user's body. Applicants prior Application Ser. No. 796,987 filed Nov. 12, 1985 discloses an apparatus including a nozzle having a discharge orifice mounted for mounted so as to cause the impacting fluid stream to sweep over an area of the user's body. The present application discloses improved embodiments for translating the stream along a substantially random path.

Other hydrotherapy devices for massaging a user's body by moving a discharge nozzle are disclosed in U.S. Pat. Nos. 4,523,340; 4,339,833; 4,220,145; and 3,868,949. Various other hydrotherapy devices for discharging water-air streams are disclosed in the following U.S. Pat. Nos. 4,502,168; 4,262,371; 3,905,358; and 3,297,025.

SUMMARY OF THE INVENTION

The present invention relates to improvements in hydrotherapy and more particularly to a method and apparatus for discharging a fluid stream, while concurrently translating the stream along a substantially random path. A user can fixedly position his body proximate to the apparatus to enable the discharged stream to impact against and sweep over an area of the user's body.

In a preferred application of the invention the apparatus is mounted in an opening in the perimeter wall (i.e. including floor) of a spa, hot tub, bathtub, etc., generically referred to herein as a water tub. The apparatus includes a housing which can be formed integral with the tub wall but which more typically comprises a separate box-like structure adapted to be mounted adjacent to the rear face of the wall and accessible through an opening in the wall.

In a preferred embodiment, an elongated conduit means is mounted in the housing having a supply end, including a supply orifice, and a nozzle end, including a discharge orifice. The conduit means supply end is mounted so as to couple the supply orifice to a fluid supply pipe and the nozzle end is left free to move within the wall opening, i.e. in two dimensions across a substantially planar area roughly approximating an extension of the tub wall. The nozzle end is oriented to discharge a fluid stream (e.g. water-air mixture) from the discharge orifice primarily in a direction along the elongation of the conduit means substantially perpendicular to the aforesaid planar area. Additionally, the fluid stream discharge produces a thrust component extending substantially perpendicular to the conduit means elongation to produce a thrust force for moving the nozzle along a path coincident with said planar area; i.e. nozzle travel area.

In accordance with an important aspect of the present invention, the apparatus is constructed so as to cause the nozzle to trace a substantially random travel path within said nozzle travel area. The area itself can be designed to be of substantially any shape or size but is preferably selected to have equal order of magnitude vertical and horizontal dimensions (i.e., vertical: horizontal $<4:1$) approximating the area of a typical users back (e.g. 8–20 inches vertical and 5–14 inches horizontal)

In accordance with a further aspect of the invention, thrust modifier means are associated with the boundary of the nozzle travel area to change the direction of the thrust component whenever the nozzle approaches the boundary.

In accordance with a first embodiment, the conduit means comprises a substantially rigid tube mounted so as to be able to swivel about its supply end to permit its nozzle end to translate across said travel area. The nozzle discharge orifice is oriented to discharge a stream having a thrust component extending substantially perpendicular to said tube to thrust said nozzle end across said travel area. The rigid tube preferably carries drag plates which encourage the nozzle end to trace a nonlinear path segment across the travel area. A thrust modifier means is provided in the form of a frame, mounted proximate to the boundary of the travel area, and a cooperating pivot pin secured to said tube. The pivot pin and nozzle end are preferably mounted so as to diverge from one another toward their free ends with each preferably being aligned with the center of rotation of the tube swivel mount. The frame includes a series of open recesses, each intended to momentarily capture the pivot pin, as the nozzle end is thrust toward the area boundary. With the pivot pin so captured, the stream thrust component acts to pivot the nozzle end around the pivot pin to thereby redirect the thrust component enabling the nozzle to withdraw the pivot pin from its open recess and initiate a new traverse across the travel area.

In common with certain embodiments disclosed in applicants aforementioned Application Ser. No. 796,987, the rigid tube conduit means of said first embodiment is preferably curved (e.g. "S" shape), defining entrance, intermediate, and exit sections. This configuration of the rigid tube minimizes the depth of the housing required for a given sized nozzle travel area while also permitting smooth flow and low pressure drops within the tube. Additionally, in order to provide sufficient thrust to start the nozzle moving and prevent it from moving too fast, a speed sensitive drag means, e.g. the aforementioned drag plates, are affixed to, and extend radially from, the conduit means.

In accordance with a second embodiment, the conduit means also comprises a substantially rigid tube mounted so as to be able to swivel about its supply end to permit its nozzle end to translate along a random path in said travel area. The thrust modifier means of said second embodiment includes a thrust director mounted on said nozzle for movement between first and second positions to respectively direct said thrust component in different first and second directions. Means are also provided for switching the position of the thrust director when the nozzle approaches the travel area boundary to redirect the thrust component.

In accordance with a further feature of the second embodiment, the rigid tube is preferably curved in a single plane and the planar orientation of the tube is maintained substantially radial to the fluid supply means nozzle axis to assure smooth flow through the conduit means.

In accordance with a third embodiment, random motion of a discharge orifice across the aforementioned two dimensional travel area is achieved using a flexible tube and relying on directed whip hose action as contrasted with properly orienting a rigid tube nozzle, as in the first and second embodiments.

In accordance with the third embodiment, the flexible tube has a first end mounted on the fluid supply means and a second discharge end essentially unrestrained and able to traverse said travel area. A buoyancy collar is mounted on the discharge end to facilitate its vertical motion.

In accordance with a significant aspect of the third embodiment, the flexible tube extends through a fixedly mounted ring which acts to limit the tube movement and bend the tube to effect more pronounced directional changes. The ring contact surface is preferably noncircular and includes an oblique chord to encourage the tube to traverse in directions other than vertically up and down.

DESCRIPTION OF THE FIGURES

FIG. 4 is a sectional view taken substantially along the plane 4—4 of FIG. 1, slightly simplified for clarity, depicting a first embodiment of the invention;

FIG. 6 is an isometric view depicting a portion of the frame used in the embodiment of FIGS. 4 and 5;

FIG. 9 is a front schematic view depicting the action of the thrust modifier means of the embodiment of FIGS. 4,5;

FIG. 10 is a front view depicting the nozzle travel path in the embodiment of FIGS. 4,5;

DETAILED DESCRIPTION

Figure 1:
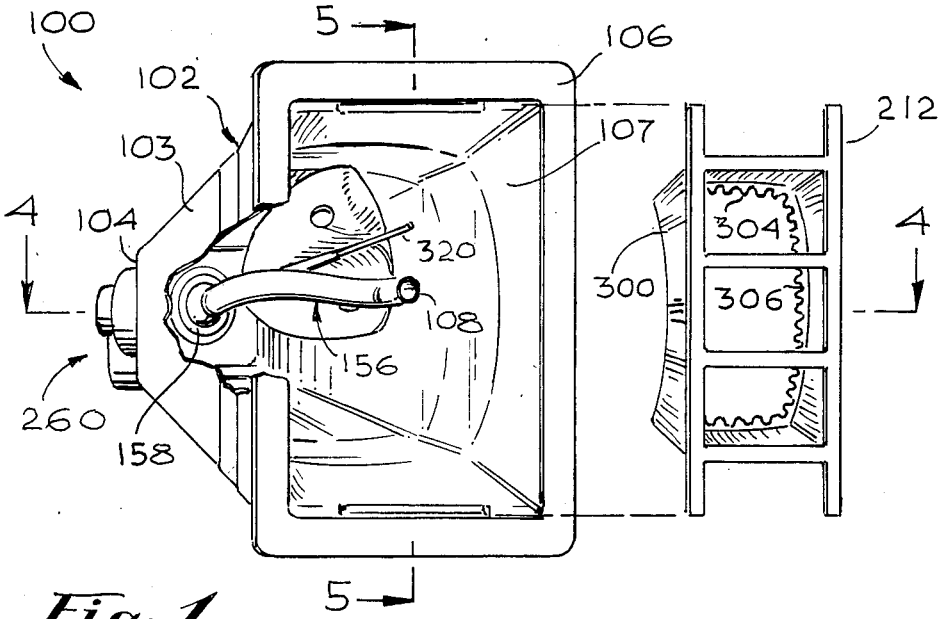
FIG. 1 is an isometric exploded view of a first embodiment of a hydrotherapy apparatus in accordance with the present invention.
Figure 2:
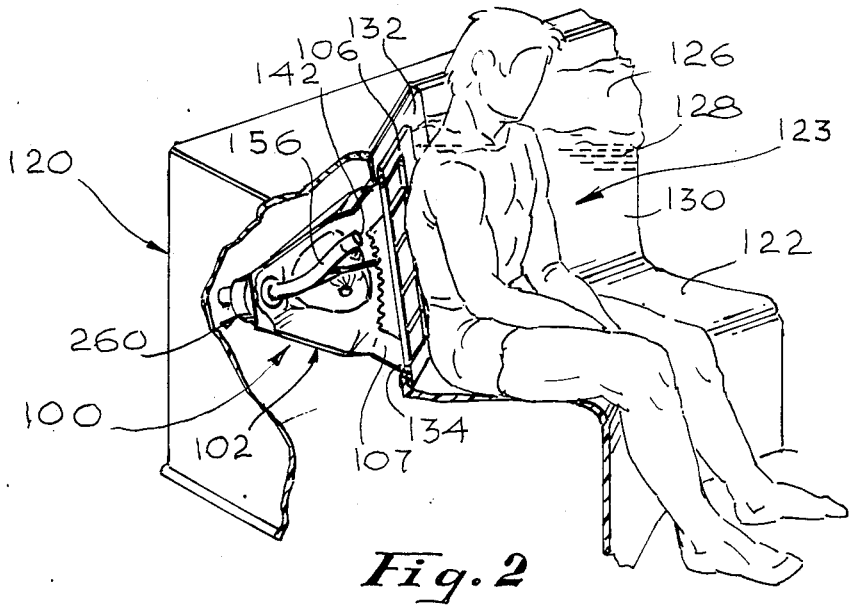
FIG. 2 is an isometric view, partially broken away, depicting the apparatus of FIG. 1 mounted behind the perimeter wall of a water tube, e.g. a spa.

Attention is initially directed to FIG. 1 which illustrates an exploded view of a hydrotherapy apparatus 100 in accordance with the present invention. The apparatus 100 is intended to be mounted adjacent to the outer surface of a perimeter wall of a water tube such as a spa, hot tub, or bath tub, as depicted in FIG. 2, for massaging the body of a user. The apparatus 100 is essentially comprised of a box-like housing 102 having side walls 103, a rear wall 104, and an open front frame 106 surrounding an essentially planar nozzle travel area 107. A nozzle 108 is mounted for random movement in the planar area 107.

FIG. 2 depicts the hydrotherapy apparatus 100 in use in a typical spa installation wherein the spa tub 120 is shaped to define, for example, a bench 122 upon which the user 123 can comfortably sit with the major portion of his body below the upper surface 126 of a water pool 128. The water tube 120 includes an inner perimeter wall 130 preferably having one or more flat portions 132 through which a wall opening 134 is formed. The apparatus 100 is intended to be mounted in the opening 134 with the housing 102 projecting rearwardly from the flat wall portion 132 and with the housing frame 106 bearing against the front surface of the flat wall portion 132.

The general function of the hydrotherapy apparatus 100 is to provide a pleasing massaging effect on the body of the user 123 without requiring that the user move his body relative to a fixedly positioned jet, as is customary in conventional spa installations. In order to achieve this effect, the apparatus 100 includes the nozzle 108 having an orifice 142 through which a water stream is discharged against the users body. The nozzle 108 is operable, as will be described hereinafter, to travel along a substantially random path coplanar with area 107 to cause the discharged water stream to sweep over and impact against a relatively large area of the users body. The random path is comprised of a sequence of path segments, all lying within area 107, and extending in various directions across the area. The vertical and horizontal dimensions of the area are typically of the same order of magnitude, e.g. vertical dimension between 8 and 20 inches and horizontal dimension between 5 and 14 inches. Although these dimensions may vary considerably in different embodiments, it is preferable if the ratio of the vertical to horizontal dimensions of the area is less than 4:1.

Figure 3:
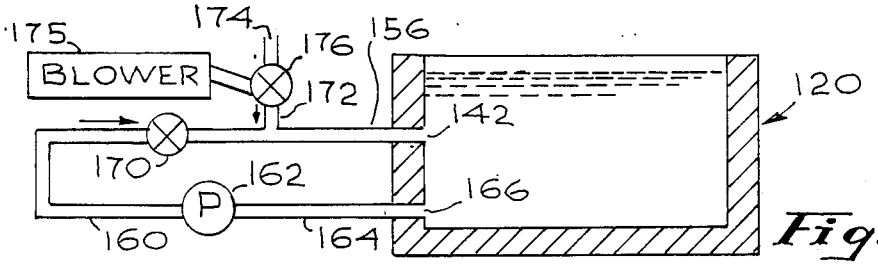
FIG. 3 is a schematic illustration depicting the manner in which an apparatus in accordance with the invention is plumbed in a typical spa installation.

As will be discussed in greater detail hereinafter, the apparatus 100 includes a conduit means 156 which supplies a water stream to the nozzle 108 from the outlet of a water supply fitting 158. Typically, the water supply fitting 158 is supplied with water from the outlet side 160 of a motor driven pump 162, schematically depicted in FIG. 3. The pump 162 has an inlet side 164 coupled to a suction port 166 formed in the wall of a water tub 120. The pump 162 sucks water from the port 166 and supplies a water stream to the conduit means 156 which is then discharged through the nozzle orifice 142 back into the water tub 120. It is preferable, but not necessary, to include a manually adjustable valve 170 in the plumbing line connecting the pump outlet 160 to the conduit means 156. It should be noted that FIG. 3 also schematically depicts an air supply pipe 172 connected to the conduit means 156. The pipe 172 is typically open to the air 174 to permit the water stream supplied by the pump 162 through conduit means 156, to draw air in through the pipe 172, as by venturi action, for mixing with the water stream. Alternatively, the air can be introduced into the water stream by a motor driven blower 175 coupled to the pipe 172. FIG. 3 also depicts a manually adjustable valve 176 mounted in the air supply pipe 172 to enable the user to control the amount of air introduced into the water stream exiting from the discharge orifice 142.

In the use of the apparatus 100, the nozzle 108 translates along a substantially random path while continually discharging the impacting water stream against a large area of a users body. As will be seen hereinafter, the nozzle 108 is driven along the random path by a thrust force, preferably produced by a component of the water stream discharged from nozzle orifice 142 in a direction parallel to the substantially planar area 107.

Figures 5, 7, 8:
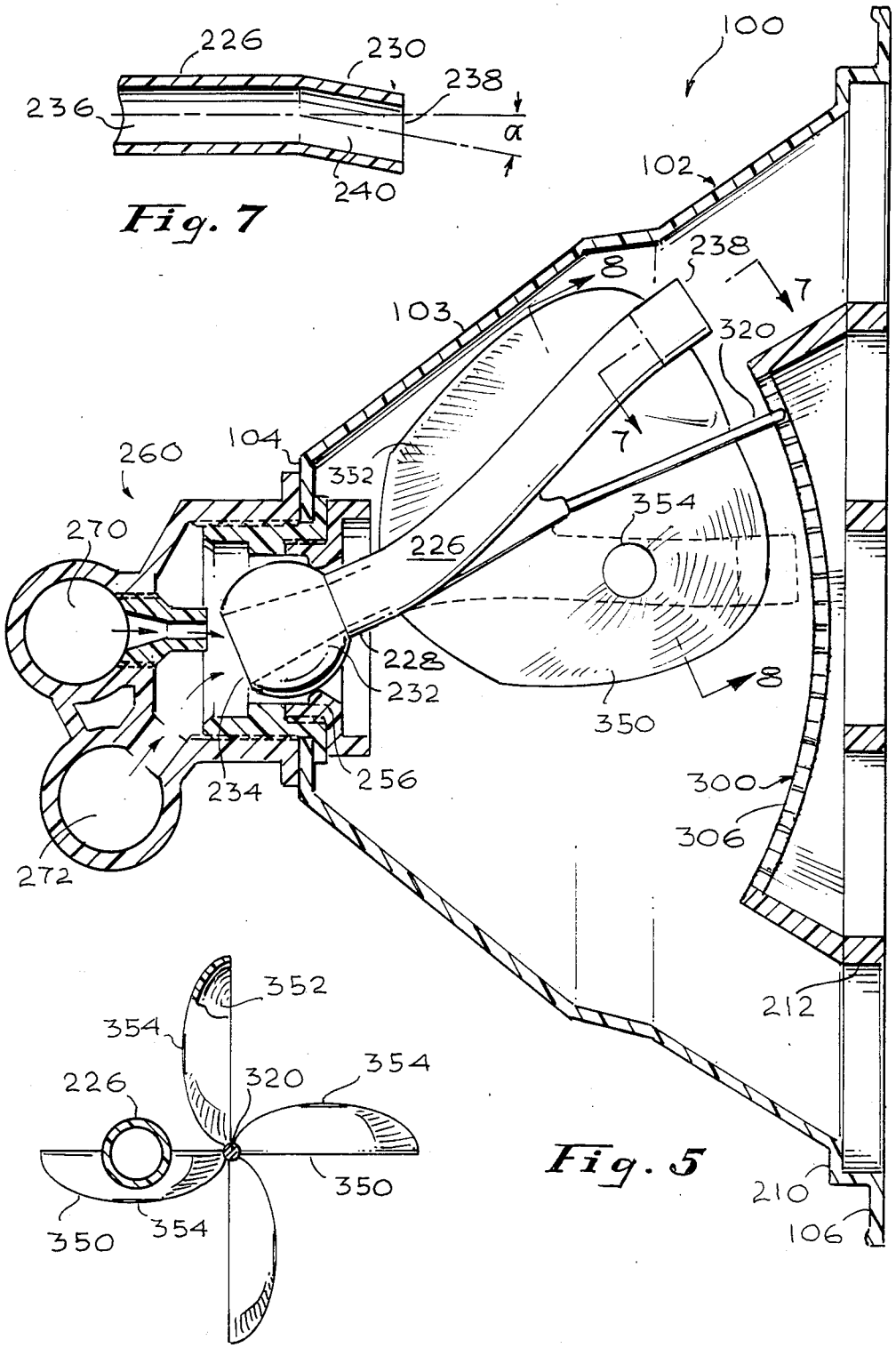
FIG. 5 is a sectional view, slightly simplified for clarity, taken substantially along the plane 5—5 of FIG. 1.
FIG. 7 is a sectional view taken substantially along the plane 7—7 of FIG. 5.
FIG. 8 is a sectional view taken substantially along the plane 8—8 of FIG. 5.

With the foregoing general description in mind, attention is now directed to FIGS. 4–10 which illustrate the apparatus 100 in greater detail. FIG. 4 depicts a horizontal sectional view taken through the apparatus 100 and looking down from the top. FIG. 5 depicts a vertical sectional view of the same apparatus 100 looking in from the side. The apparatus housing 102 has side walls 103 and a rear wall 104. The front of the housing is open with frame 106 surrounding the essentially planar area 107. The frame 106 is shaped to define a shoulder 210 against which an open grill 212 is mounted.

A conduit means 156 is mounted in the housing 102 for discharging a moving water stream through the grill 212. The conduit means 156, in the embodiment of FIGS. 4–10, comprises a rigid tube 226 having a supply end 228 and a nozzle end 230. A ball 232 is fixedly mounted on the tube supply end 228 and defines a tapered central bore comprising a supply orifice 234. The orifice 234 opens into an internal passageway 236 extending through tube 226 to discharge orifice 238 in the nozzle end 230 (FIG. 7). The internal passageway 236 extending from the supply end 228 to the nozzle 230 has a central axis essentially lying in a single plane. However, the internal passageway 240 within the nozzle 230 defines an axis diverting at a small angle $\alpha$ (e.g. 15°) from the axis of internal passageway 236.

The ball 232 of the conduit means 156 is mounted for swivel movement about its center. More specifically, the mounting means for ball 232 includes a flanged pipe section 250 having an internally threaded bore 251. The pipe section 250 extends rearwardly through an opening in the rear wall 104 of housing 102 with the pipe section flange 252 bearing against wall 104.

An externally threaded fitting 254 is provided with is threaded at 253 into the internally threaded bore 251 of pipe section 250. Fitting 254 has a central bore 255 through which the tube 226 extends. A radially inwardly projecting lip 256 is formed in bore 255 to define a socket surface against which ball 232 can rotate. A water-air jet subassembly 260 is threaded (or otherwise equivalently fastened, as by an adhesive) to the external threads of the pipe section 250. The subassembly 260 includes a water inlet 270 and an air inlet 272. Water under pressure entering the inlet 270 is discharged through a short nozzle member 274 into a cavity 276. The discharged water stream is then mixed with air entering from the air inlet 272. The air can be drawn in through the inlet 272 via venturi action caused by the water exiting from the nozzle 274, or alternatively, air can be supplied to the inlet 272 by a blower (FIG. 3). The water-air stream discharged into the bore 234 of the ball 232 essentially seats the ball surface against the lip 256 of the fitting 254 to prevent leakage therepast. By proper choice of materials, the ball 232 can nevertheless freely rotate with respect to the lip surface 256.

By allowing the surface of ball 232 to rotate within the bore of fitting 254, the nozzle end 230 of tube 226 is free to traverse along substantially any path lying within a defined area of an essentially planar imaginary surface. The surface is, of course, defined by the locus of all points of the nozzle travel path as the ball 232 is rotated in its socket against lip 256. The surface may be considered as a two dimensional essentially planar area, although indeed it is slightly spheric.

A water-air stream supplied under pressure into the bore 234 of the ball 232 will traverse the internal passageway 236 of the tube 226 and emerge through the passageway 240 of nozzle 230 and the discharge orifice 238. With the small angular deviation $\alpha$ of the axis of the nozzle passageway 240 (FIG. 7), the discharge stream may be considered as having a primary component, extending substantially along the elongation of the tub 226, and a secondary component extending substantially transverse to the elongation of the tube 226. The primary component is discharged into the tube for impacting against and massaging a user. The secondary component produces a thrust force which acts on the nozzle 230 to move it within the aforementioned planar area, as the ball 232 rotates against lip surface 256. In order to cause the nozzle to trace sequential path segments across the planar area, as contrasted with being forced and held against a boundary thereof, means are provided for modifying the direction of the thrust force produced on the nozzle 230 as it approaches the boundary of the planar area.

In the embodiment of FIGS. 4–10, this thrust modifier means includes a frame 300 carried by the aforementioned grill 212. The frame 300 includes an internal scalloped edge 304 defining a series of open recesses 306. In addition, the thrust modifier means of FIGS. 4–10 includes a pin 320, received in pin socket 321, fixed to the tube 226. The pin 320 is mounted in socket 321 so as to lie substantially in the plane of tube 226, extending substantially along the axis of bore 234 and through the center of rotation of ball 232. The tube 226 is preferably "S" shaped defining an entrance section 322 immediately downstream from supply orifice 234, an exit section 324 immediately upstream from discharge orifice 238, and an intermediate section 326 therebetween. The sections 322, 324, 326 lie in a single plane, connected by gentle curves. The entrance section is preferably oriented to diverge by only a small angle, e.g. $<20°$, from the axis of bore 234 to assure smooth flow and low pressure drops. The exit section 324 extends substantially in alignment with the center of rotation of ball 232 but it diverges from the pin 320 toward their free ends as depicted in FIGS. 4 and 5.

In order to understand the operation of the embodiment of FIGS. 4 and 5, initially assume that the tube 226 is in the solid line position depicted in FIG. 5. In that position, note that the nozzle passageway 240 is tilted down into the plane of the paper. As a consequence, the water-air stream discharged through the orifice 238 will produce a thrust force on the nozzle 230 tending to lift it out of the plane of the paper as the ball 232 rotates in its socket. Movement of the nozzle 230 out of the plane of the paper in FIG. 5, of course, corresponds to essentially horizontal movement of the nozzle 230 in the installed apparatus as depicted in FIG. 2. With the tube 226 and pin 320 so moving, as the nozzle approaches the boundary of its planar area, the pin 320 will be temporarily captured in one of the open recesses 306 of frame 304, as is best depicted in FIG. 9. With the pin so captured, the continuing thrust force produced by the thrust component of the discharged water stream will pivot the nozzle 230 around the pin until the thrust force acts in a direction to free or remove the pin from the recess in which it is captured. This will then enable the nozzle to embark on its next path segment traversing the area toward an opposite side of the scalloped frame 300. In this manner, the nozzle will trace sequential path segments across the planar area. As a consequence of drag means affixed to the tube 226, to be discussed hereinafter, the nozzle will trace a somewhat nonlinear path segment between recesses on opposite sides of the frame 300. Of course, between successive path segments, the nozzle will move along a small semicircular path as it frees the pin 320 from the recess 306 in which it is captured, as depicted in FIG. 9.

The speed with which the nozzle moves through the water depends upon several factors including the pressure and magnitude of the stream discharge and the angle $\alpha$ at which the nozzle passageway 240 diverts from the passageway 236. The force with which the discharged stream impacts against the users body for massaging is similarly dependent upon these factors. As is depicted in FIG. 3, it is desirable to provide the user with a manual valve 170 to enable him to control the impact force against his body. The pump 162, for example, can typically provide an output pressure of 30 psi and the user may desired to cut this down substantially for comfort. In order to enable the user to vary the impact force without significantly changing the speed with which the nozzle translates along its travel path, it is desirable to select the stream discharge angle $\alpha$ to yield sufficient nozzle movement speed at a relatively low pressure, e.g. 10–15 psi. Additionally, it is necessary to select the discharge angle so it is sufficient to provide an adequate starting thrust regardless of the position of the nozzle when the system is initially turned on. It should of course be appreciated that the magnitude of thrust required to assure that the nozzle comes up to speed from rest is greater than that required to maintain the speed of the nozzle once it is already in motion. In order to accommodate a discharge angle sufficient to ensure start up and yet prevent the nozzle means from thereafter moving at an uncomfortably high speed, a speed sensitive drag means is incorporated in the embodiment of FIGS. 4–10.

More specifically, the speed sensitive drag means comprises one or more cupped plates 350 mounted on and extending substantially radially from the primary axis of the rigid tube 226, defined by ball bore 234 and pin 320. Each plate 350 is internally cupped to provide a cone-like internal surface 352 having an aperture 354 at its apex. Each cupped plate 350 acts similarly to a sea anchor in that it exhibits a very low drag at low speed and increasing drag as the tube 226 attempts to move more quickly through the water. Preferably, four cupped plates 350 are used extending radially outward from the tube 226 in cruciform fashion as shown in FIG. 8. For clarity, only two of the cupped plates are illustrated in FIG. 4 and 5. Because the plates produce nonsymmetric drag as the nozzle and pin move through the water along a path segment, they cause the nozzle to trace a nonlinear path between opposite sides of frame 300, and thus an essentially random path along the travel area.

Attention is now directed to FIGS. 11–18 which illustrate a second embodiment in accordance with the present invention for moving a discharge nozzle along a substantially random path within an essentially planar area. The embodiment of FIGS. 11–18 is structurally similar to the previously discussed embodiment of FIGS. 4–10 in that it includes a housing 402 having side walls 404 and a rear wall 406. The housing is open at its front 408 and a grill 410 is mounted across the opening.

Additionally, a conduit means 412 is provided in the form of a rigid tube 414 having a ball 415 fixedly mounted on its supply end 416. The tube 414 differs from tube 226 of FIGS. 4–10 at its nozzle end 417 in that the axis of the nozzle end internal passageway 418 is not diverted as is characteristic of the tube 226 (FIG. 7). Rather, in the embodiment of FIGS. 11–18, a funnel-shaped nozzle extension member 420 is provided to discharge the stream in a direction having a primary massage component extending along the elongation of the tube and a secondary thrust component extending transverse to the elongation of the tube. The nozzle extension member 420 is mounted for pivotal movement on aligned pins 421, 422 (FIG. 15) between first and second positions, respectively illustrated in solid and dashed line form in FIG. 14, to enable the direction of the thrust component to be changed.

Figure 14:
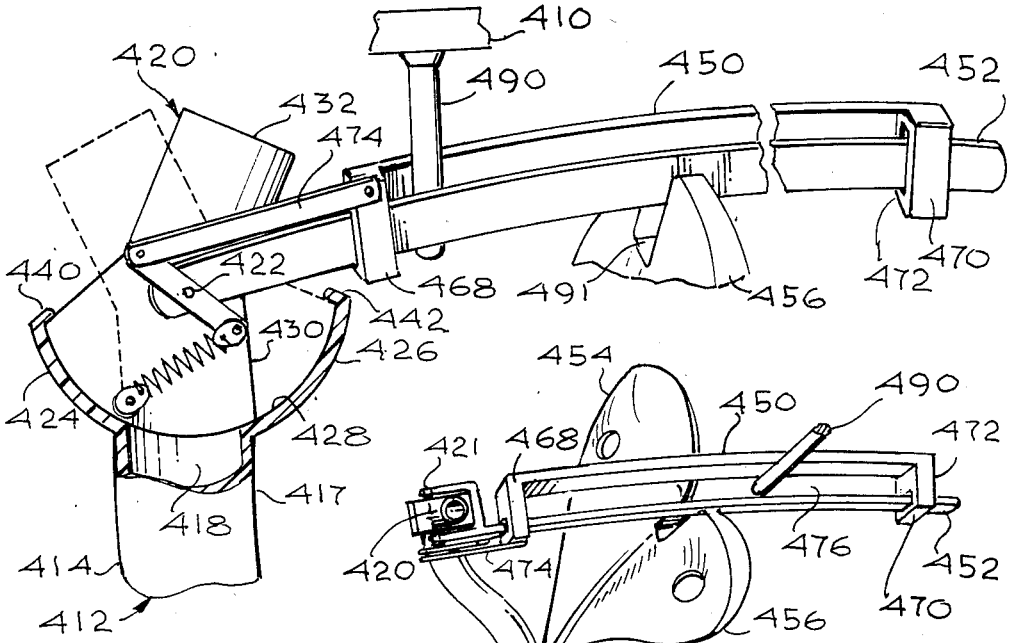
FIG. 14 is a side view, partially broken away, primarily depicting the thrust modifier means, and particularly the thrust director, means of the embodiment of FIG. 11.

More particularly, as can be noted in FIG. 14, the nozzle end of tube 414 terminates in outwardly radially directed arms 424 and 426. The arms 424 and 426 together define a concave substantially cylindrical inner surface 428. The nozzle extension member 420 has a flared entrance end 430 and a substantially cylindrical discharge end 432. The flared entrance end 430 is shaped to mate with and slide on the inner cylindrical surface 428 defined by arms 424 and 426. Thus, the nozzle extension member 420 can move from the solid line position depicted in FIG. 14 in which it abuts shoulder 440 to the dashed line position in which it abuts shoulder 442. In either position, the internal passageway 418 of the tube 414 communicates with the internal passageway through the nozzle extension member 420. When in the clockwise solid line position (FIG. 14), the nozzle extension member 420 will discharge a stream whose primary component is in the plane of the paper issuing upwardly and whose secondary component is in the plane of the paper issuing to the right. In the counter clockwise dashed line position of FIG. 14, the nozzle extension member 420 will discharge a stream having a similarly directed primary component but a secondary component issuing to the left. Thus, depending upon the position of the nozzle extension member 420, a thrust force will be developed for urging the tube nozzle end 417 in the plane of the paper of FIG. 14 either to the left or the right.

Figure 13:
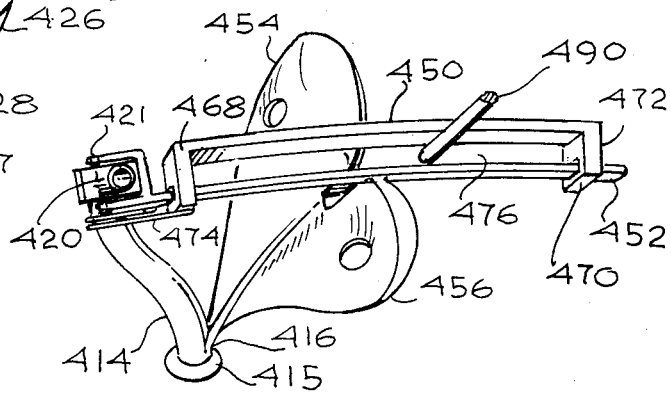
FIG. 13 is an isometric view primarily depicting the moving components of the embodiment of FIG. 11.

The mechanism for switching the position of the nozzle extension member 420 includes a U-shaped slider 450 mounted for sliding movement on an arm 452. The arm 452, which supports the aforementioned pins 421, 422, is secured to cupped drag plates 454, 456 which in turn are affixed to rigid tube 414 (FIG. 13). The tube 414 is preferably "S" shaped, similar to aforedescribed tube 226 (FIGS. 4–10), and the arm 452 extends essentially transverse to the elongation of the tube. The slider 450 is comprised of first and second collars 468 and 470 which are connected by a cross member 472. The cross member 472 extends parallel to the rod 452 but is spaced therefrom by a slot 476.

A pusher rod 474 is connected to collar 468 for pivotal motion about pin 477. The second end of pusher rod 474 is pivotally connected to link 478 by pin 479. Link 478 is mounted for pivoting about aforementioned pin 422, located intermediate its ends. The lower end 480 of link 478 is connected to the first end of a coil spring 482. The second end of the coil spring is connected to stud 484 affixed to the lower edge of the nozzle extension member 420.

A pin 490 is affixed to the grill 410 aligned with the axis of a jet subassembly 492 discharge nozzle 494. The nozzle 494 discharges a water-air stream into the supply orifice of the aforementioned ball 415. The pin 490 extends into the slot 476 between the slider cross member 472 and the arm 452.

Figure 16:
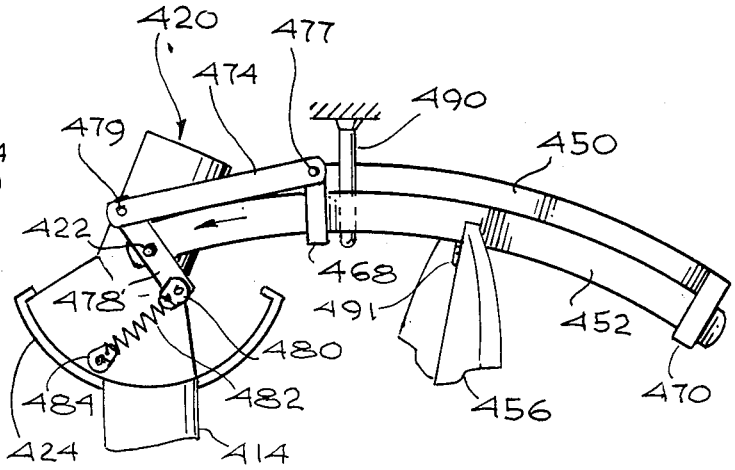
FIG. 16 is a front schematic view depicting a first orientation of the thrust director means.
Figure 17:
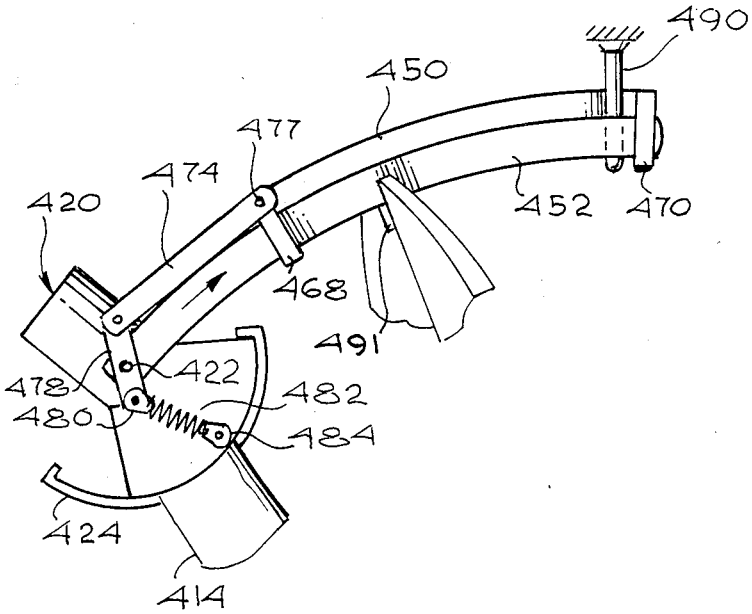
FIG. 17 is a front schematic view depicting a second orientation of the thrust director means.
Figure 18:
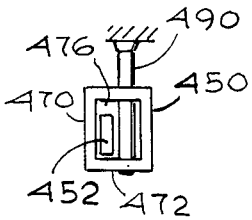
FIG. 18 is an end view primarily depicting the relationship between the rigid tube radial arm, the slider, and the fixed pin.

In the operation of the embodiment of FIGS. 11–18, initially consider that the tube 414 has swiveled to the solid line position depicted in FIG. 14 with the nozzle extension member oriented clockwise and located close to the pin 490. This same position of the tube 414 and nozzle extension member 420 is schematically depicted in FIG. 16. With the member 420 oriented clockwise, it will discharge a stream having a secodary component acting to thrust the nozzle 417 to the left, as depicted in FIG. 16, relative to the pin 490. The pin 490 will of course remain fixed and the slider 450 and arm 452 will move with respect to the pin 490. As the slider 450 and arm 452 move to the left from the position depicted in FIG. 16, the slider collar 470 will move into engagement with the fixed pin 490. As the discharge stream continues to thrust the nozzle further to the left, the pin 490 acting on the collar 470 will slide the slider 450 to the right relative to the arm 452. This action moves pusher rod 474 to the right thereby pivoting link 478 clockwise around pin 422. Thus, the lower end 480 of link 478 moves toward stud 484 thereby compressing coil spring 482. More particularly, as the link 478 pivots clockwise about pin 422, the coil spring 482 will move from its extended position depicted in FIGS. 416 to a compressed position as the link end 480 moves close to stud 484. As soon as link 478 rotates clockwise beyond this neutral position, the spring then acts on stud 484 to quickly push the stud to the right and thereby pivot the nozzle extension member 420 counterclockwise as shown in FIG. 17. With the nozzle extension member 420 in the counterclockwise position, the discharge stream will produce a component thrusting the nozzle 417 to the right (FIG. 17). This action will of course slide slider 450 and arm 452 to the right relative to pin 490. As previously mentioned, the pin 490 extends through slot 476 between the slider 450 and arm 452. A notch 491 is formed between the drag plates 454 and 456 to permit the pin 490 to pass therethrough. After the nozzle 417 has moves to the right sufficiently, slider collar 468 will engage pin 490 and as a consequence pusher rod 474 will be forced to the left (FIG. 17) to thus pivot link 478 counterclockwise about pin 422. As a consequence, the lower end 480 of the link 478 will move in a path to a neutral position, initially compressing the spring 482, and as the end 480 moves past the neutral position, the spring 482 will quickly expand to drive the nozzle extension member 420 back to the clockwise position depicted in FIG. 16.

Thus, the nozzle extension member 420 will be alternately switched, as a consequence of the aforedescribed cam over mechanism, from a clockwise position to a counterclockwise position and then back again as the slider 450 and arm 452 move essentially linearly with respect to fixed pin 490.

Figure 11:
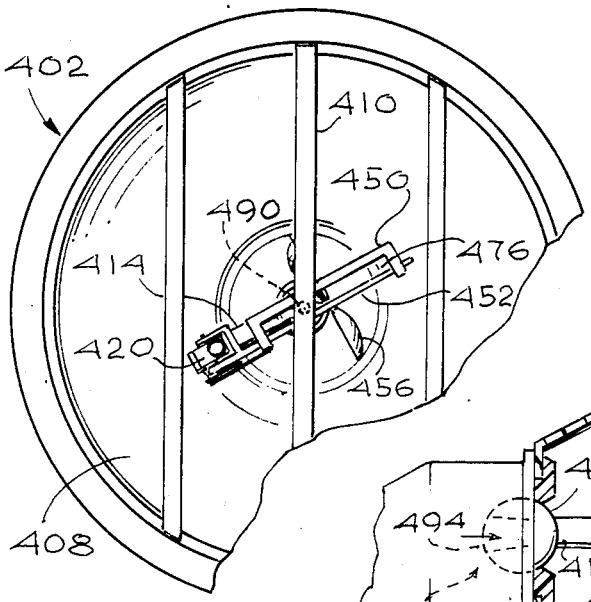
FIG. 11 is a front view of a second embodiment of the invention.
Figure 12:
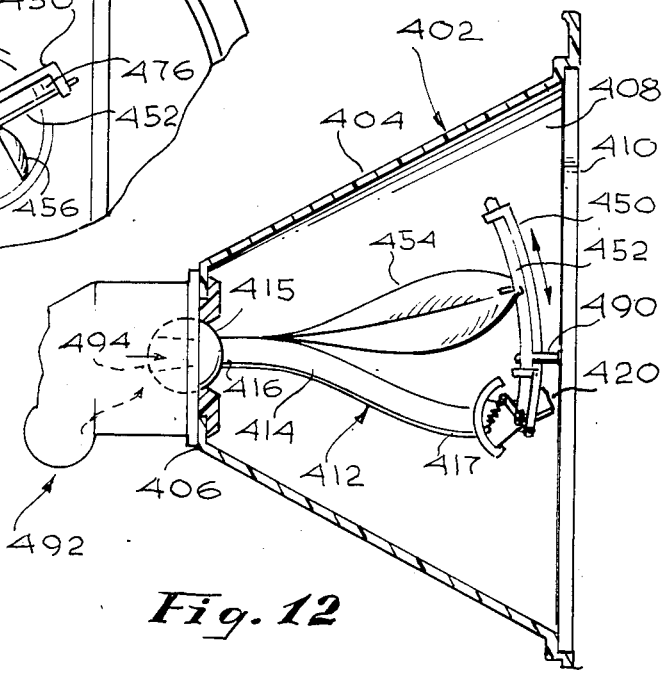
FIG. 12 is a vertical sectional view taken through FIG. 11.
Figure 15:
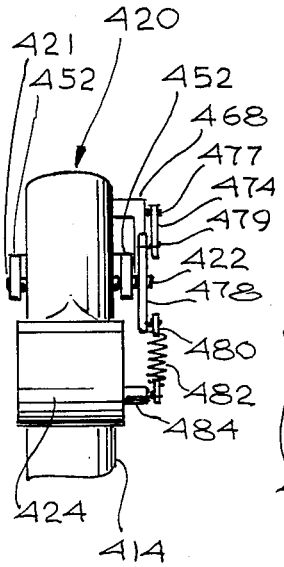
FIG. 15 is an end view of the thrust director means of FIG. 14.

Although the slider 450 and arm 452 may be viewed as moving linearly with respect to the pin 490 to alternately switch the nozzle extension member 420 to change the direction of the thrust component, the tube 414 will concurrently slowly rotate about the ball 415, primarily as a consequence of the nonsymmetric drag produced by the drag plates 454 and 456. This nonsymmetric drag is attributable to the cupped drag plates being oppositely oriented, as depicted in FIGS. 11 and 13. Thus, the nozzle extension member 420 will traverse a substantially random path as it moves both linearly with respect to the pin 490 while the tube 414 is concurrently rotating about the center of rotation of ball 415.

It should be recalled that the tube 414 is essentially comprised of an entrance section, an exit section, and an intermediate section connected by gentle curves. The sections lie in a single plane and the slider 450 and arm 452 preferably lie in the same plane. As a consequence, the plane of the tube 414 is maintained substantially radial to the axis of the jet subassembly nozzle 494 thereby maintaining the orientation of the entrance section of the tube 414 at a relatively small angle relative to the nozzle 494 to assure smooth flow and low pressure drops.

It is furthr mentioned that the cupped plates 454, 456 in addition to nonsymmetrically affecting the movement of the tube 414 through the water, limit the speed of movement, as has been described in connection with the embodiment of FIGS. 4–10.

Figure 19:
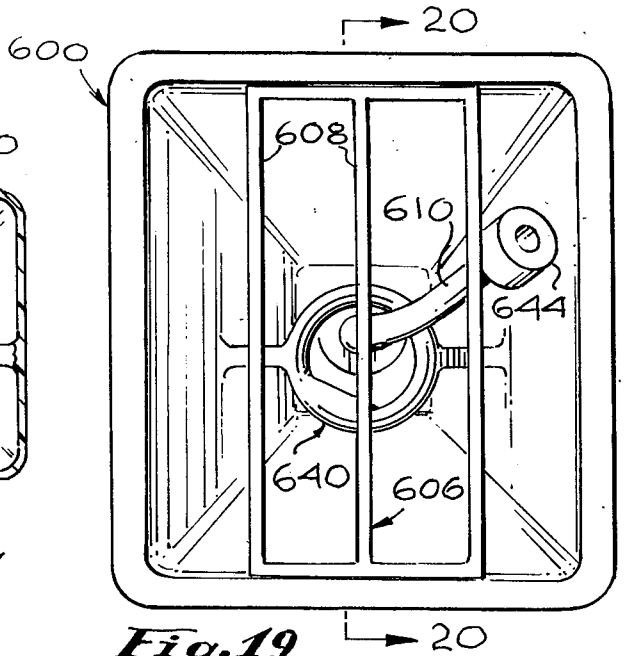
FIG. 19 is a front view of a third embodiment of the invention.
Figure 21:
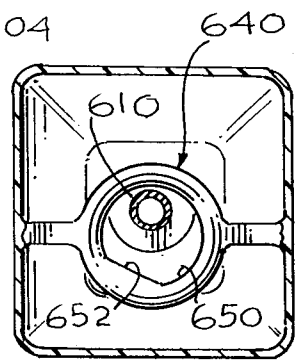
FIG. 21 is a sectional view taken substantially along the plane 21—21 of FIG. 20.
Figure 20:
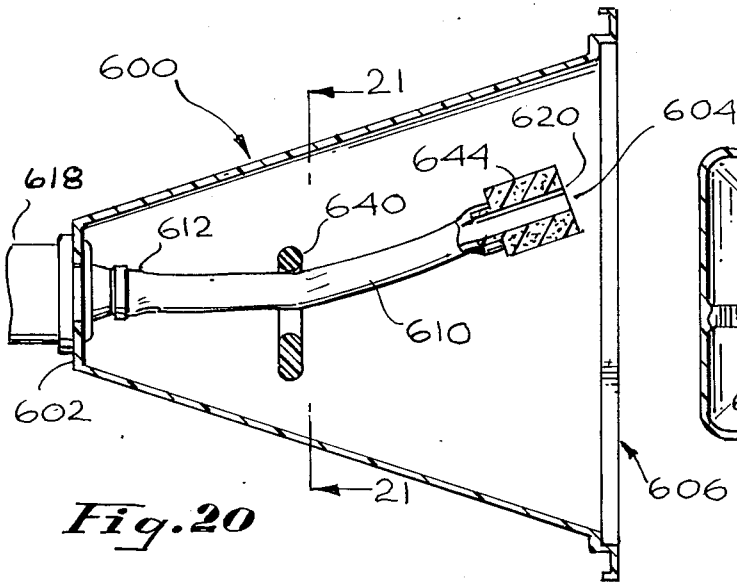
FIG. 20 is a side sectional view taken substantially along the plane 20—20 of FIG. 19.

Attention is now directed to the embodiment of FIGS. 19–21. This embodiment is similar to the embodiments previously discussed in that it too includes a housing 600 intended to be mounted within an opening in a peripheral wall of a water tub. The housing has a rear wall 602 which is supplied with a water stream, to be discussed in more detail hereinafter, which is then discharged through a nozzle 604. which can move randomly in an essentially planar area proximate to the open front of the housing 600. A grill 606 comprised or vertical bars 608 is mounted at the open front of the housing 600.

Figure 22:
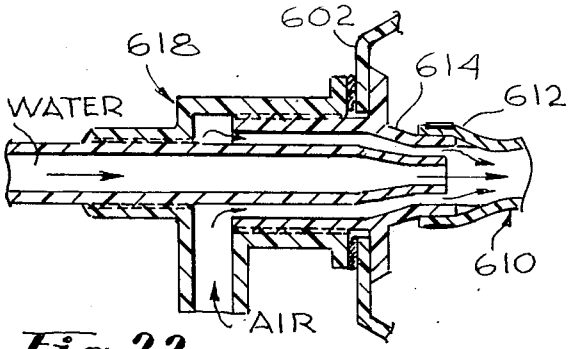
FIG. 22 is a side sectional view showing the manner of mixing air and water at the supply end of the tube in the embodiment of FIG. 19.

In contrast to the two aforediscussed embodiments which utilize rigid tubes as the conduit means connecting the water supply to the discharge nozzle, the embodiment of FIGS. 19–21 utilizes a flexible tube or hose 610 for supplying a water stream to the nozzle 604. The first or supply end 612 of the tube 610 is fixedly mounted onto a water stream inlet nozzle 614 of a jet subassembly 618 (FIG. 22). The flexible tube 610 terminates at its forward end at nozzle 604 which includes a discharge orifice 620. As is well known, if the flexible tube 610 defines any shape other than a perfect column, then the water stream exiting therefrom will produce a lateral thrust component which will tend to move the nozzle transverse to the elongation of the tube. The present invention, in the embodiment of FIGS. 19–21, is particularly constructed to utilize this whip hose action to direct the nozzle 604 along a substantially random two dimensional path.

In order to thrust the nozzle along such a path, a ring member 640 is fixedly mounted in the housing forward of the rear wall 602. The axis of the ring member 640 is displaced slightly below the axis of the jet subassembly 618 nozzle in order to assure that the tube 610 does not form a straight column outward from the jet subassembly nozzle 614. Additionally, a buoyancy collar 644 is preferably mounted around the nozzle 604 to assist the nozzle 604 to move vertically against gravity and to introduce a more pronounced bend in the tube 620 when in its quiescent state, i.e. when no water stream is being discharged therethrough. The buoyancy collar 644 may be foremd of solid flotation material or alternatively, it can be filled with air, either permanently or via venturi action, as is depicted in U.S. Pat. No. 4,523,340.

The ring member 640 is provided with a noncircular internal contact surface 650, best depicted in FIG. 21. More specifically, it is preferable that the internal contact surface 650 of ring member 640 include one or more obliquely extending chords 652. Moreover, in order to reduce contact wear, the ring member contact surface is preferably formed by one or more rollers (not shown).

In use, the tube 610 and nozzle 604 will generally assume the position depicted in FIG. 20 in its quiescent state. When a water-air stream is supplied into the tube 610 and discharged from the nozzle 604, the lateral component thereof will produce a thrust force on the nozzle 604 causing it to whip across the substantially planar area at the front of the housing 600. Regardless of which direction the tube 610 tranverses, it will engage the inner contact surface 650 of the fixedly mounted ring member 650 which will thereby bend the tube and thus reorient the nozzle to modify the thrust component to push the nozzle in the opposite direction. By utilizing the ring 640 having an inner contact surface 650 extending around 360°, the nozzle 604 is essentially free to traverse a two dimensional path in the planar area. In order to prevent the tube 610 from adopting a one dimensional path, e.g. vertically up and down, the oblique chord 652 is provided in the contact surface 650 to encourage the tube to follow a somewhat lateral direction.

Figure 23:
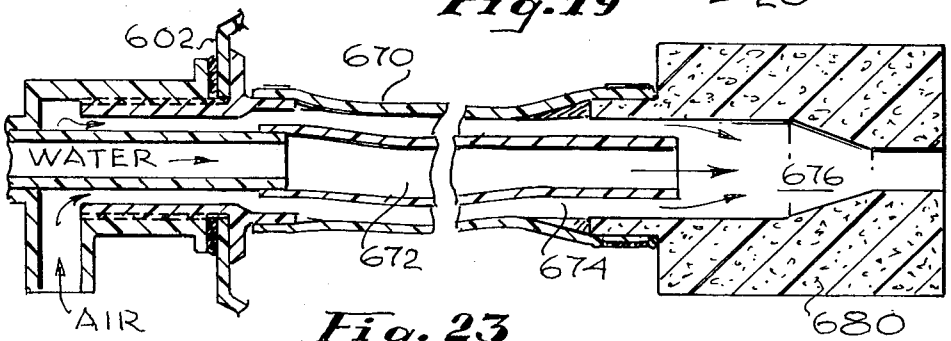
FIG. 23 is a side sectional view showing an alternative manner of mixing air and water at the discharge end of the tube.

It has been assumed thus far in the description of the embodiment of FIGS. 19–21 that the tube 610 defines a single internal passageway supplied with a water-air stream from the jet subassembly 618. In order to produce even greater thrust from a given water supply, an alternative configuration is depicted in FIG. 23 in which a tube 670 is substituted for the tube 610. The tube 670 is comprised of concentric passages 672 and 674 for respectively passing water and air which are then mixed, via venturi action, in a chamber 676 of the nozzle member 680.

From the foregoing, it should now be appreciated that mutliple embodiments of a hydrotherapy apparatus have been disclosed herein in which a nozzle is caused to traverse along a substantially random two dimensional path to discharge a water stream substantially perpendicular to the path for massaging a user.

We claim:

1. Hydrotherapy apparatus for discharging a fluid stream substantially in a first direction for impacting against a user's body, said apparatus comprising:

fluid supply means;

elongated conduit means having a first end including a supply orifice and a second end including a nozzle having a discharge orifice;

means mounting said conduit means first end for coupling said supply orifice to said fluid supply means for supply fluid to said discharge orifice, said mounting means permitting said nozzle to randomly traverse a substantially planar area spaced from said first end;

said discharge orifice being oriented to discharge a first fluid stream component in a direction extending along said conduit means elongation in said first direction; and means applying a transverse thrust force to said nozzle for moving said nozzle across said area.

2. The apparatus of claim 1 wherein said conduit means comprises a rigid tube; and wherein said mounting means includes swivel means for coupling said rigid tube first end to said fluid supply means.

3. The apparatus of claim 2 wherein said swivel means includes mating ball and socket surfaces.

4. The apparatus of claim 2 wherein said rigid tube defines an internal passage including one or more gradual curves to obtain smooth fluid flow therethrough for multiple orientations of said tube.

5. The apparatus of claim 2 including drag means coupled to said rigid tube for limiting the speed of movement of said nozzle across said area.

6. The apparatus of claim 2 wherein said area has perpendicular first and second dimensions having a ratio of less than 4:1.

7. The apparatus of claim 1 wherein said means applying said thrust force comprises means for discharging a fluid stream thrust component from said discharge orifice in a direction extending substantially parallel to said planar area.

8. The apparatus of claim 7 including thrust modifier means for redirecting said thrust component in response to said nozzle approaching a boundary of said area for causing said nozzle to randomly traverse said area.

9. The apparatus of claim 8 wherein said thrust modifier means includes:

a pin secured to said conduit means extending in substantially the same direction as, but laterally displaced from, said nozzle; and means associated with said area boundary for pivoting said nozzle around said pin.

10. The apparatus of claim 8 wherein said conduit means comprises a rigid tube; and wherein said mounting means includes swivel means for coupling said rigid tube first end to said fluid supply means.

11. The apparatus of claim 10 wherein said rigid tube includes one or more gradual curves therein and wherein the axis of said nozzle is laterally displaced from the axis of the first end of said tube.

12. The apparatus of claim 11 wherein said thrust modifier means includes:

a pin secured to said tube extending substantially in the same direction as, but laterally displaced from, said nozzle; and a plurality of open recesses extending around said area for temporarily receiving said pin to cause said thrust force to pivot said nozzle around said pin and redirect the direction of movement of said nozzle across said area.

13. The apparatus of claim 8 wherein said conduit means comprises a rigid tube and wherein said thrust modifier means includes:

thrust director means mounted on said rigid tube adjacent to said discharge orifice for movement between first and second positions for respectively directing said thrust component in different first and second directions.

14. The apparatus of claim 13 including actuator means for switching said thrust director means between said first and second positions as said nozzle approaches said area boundary.

15. The apparatus of claim 14 wherein said actuator means includes a fixedly mounted actuator member for engaging said thrust director means for switching it from said first to said second and from said second to said first positions.

16. The apparatus of claim 2 including asymmetric drag means coupled to said rigid tube for modifying the direction of movement of said nozzle across said area.

17. The apparatus of claim 10 including drag means coupled to said rigid tube for limiting the speed of movement of said nozzle across said area.

18. The apparatus of claim 10 including asymmetric drag means coupled to said rigid tube for modifying the direction of movement of said nozzle across said area.

19. Hydrotherapy apparatus for discharging a water stream substantially in a first direction for impacting against a user's body, said apparatus comprising:

inlet means for supplying water under pressure;

an elongated flexible tube having a first end including a supply orifice and a second end including a nozzle having a discharge orifice;

means fixedly mounting said tube first end in axial alignment with said inlet means for supplying water from said inlet means to said discharge orifice, said mounting means permitting said nozzle to randomly traverse a substantially planar area spaced from said first end; and means bending said tube between said first and second ends to discharge a first water stream component in said first direction, and a second water stream component substantially transverse to said first direction for moving said nozzle across said area, said bending means including a ring extending around said tube; and means fixedly supporting said ring to engage said tube and prevent the formation of an uninterrupted column therein.

20. The apparatus of claim 19 including means for producing buoyancy proximate to said tube second end.

21. The apparatus of claim 19 wherein said ring extending around said tube has an inner contact surface which is continuous but noncircular.

22. The apparatus of claim 19 wherein said area has perpendicular first and second dimensions having a ratio of less than 4:1.

23. Hydrotherapy apparatus defining a substantially planar area for discharging a fluid stream substantially perpendicular to said area while concurrently translating said stream along a substantially random path lying in said area, said apparatus comprising:

nozzle means having a discharge orifice;

means mounting said nozzle means for substantially unrestricted movement within said area;

means for supplying a fluid stream to said nozzle means for discharge through said discharge orifice; and means orienting said nozzle means for discharging said stream in a direction having a primary component extending substantially perpendicular to said area for impacting against a user's body and a thrust component extending substantially parallel to said area for moving said nozzle means across said area, said area having perpendicular first and second dimensions having a ratio of less than 4:1.

24. The apparatus of claim 23 including thrust modifier means for varying the orientation of said nozzle means in response to said nozzle means approaching the boundary of said area for changing the direction of said thrust component to cause said nozzle means to sequentially travel along different path segments across said area.

25. The apparatus of claim 24 wherein said thrust modifier means includes:

a pin secured to said nozzle means extending in substantially the same direction as, but laterally displaced from, said nozzle means; and means associated with said area boundary for pivoting said nozzle means around said pin to redirect said thrust component.

26. The apparatus of claim 24 wherein said thrust modifier means includes thrust director means mounted on said nozzle means adjacent to said discharge orifice for movement between first and second positions for respectively directing said thrust component in first and second different directions.

27. In combination with a water tub having a peripheral wall and an opening therein, apparatus mounted adjacent to said opening for discharging a water stream through said opening into said tub and for concurrently translating said stream in a direction transverse to said stream, said apparatus comprising:

a housing mounted adjacent the outer surface of said peripheral wall defining a substantially planar nozzle travel area substantially coincident with said wall opening, said travel area having perpendicular first and second dimensions having a ratio of less than 4:1;

a pressurized water source means;

a nozzle having a discharge orifice;

means mounting said nozzle in said housing for substatially unrestricted translation across said travel area;

means coupling said water source means to said nozzle for discharging a water stream through said discharge orifice;

means orienting said nozzle to discharge a primary stream component in a direction extending substantially perpendicular to said travel area; and means for thrusting said nozzle along a substantially random path coincident with said travel area.

28. The combination of claim 27 wherein said area has a vertical dimension between 8 and 20 inches and a horizontal dimension between 5 and 14 inches.

29. The combination of claim 27 wherein said means for thrusting includes means for discharging a secondary stream component in a direction extending substantially parallel to travel area.

30. The combination of claim 27 wherein said coupling means comprises a rigid tube.

31. The combination of claim 27 wherein said coupling means comprises a flexible tube.

32. Hydrotherapy apparatus for discharging a fluid stream for impacting against a user's body, said apparatus comprising:

fluid supply means for supplying a pressurized water flow along an entrance axis;

elongated conduit means having a first end including a supply orifice and a second end including a discharge orifice;

means mounting said conduit means first end proximate to said fluid supply means for directing said water flow through said conduit means to said discharge orifice, said mounting means positioning said conduit means second end to permit said discharge orifice to travel along a substantially random path defining a substantially planar area spaced from said conduit means first end;

said conduit means including means for diverting said water flow away from said axis to produce a lateral thrust on said conduit means second end for moving said discharge orifice along said substantially ramdom path.

33. The apparatus of claim 32 including thrust modifier means for redirecting said lateral thrust in response to said conduit means second end approaching a boundary of said area for causing said discharge orifice to randomly traverse said area.

34. The apparatus of claim 32 wherein said conduit emans comprises a rigid tube; and wherein said mounting means includes swivel means for coupling said rigid tube first end to said fluid supply means 35. The apparatus of claim 34 wherein said swivel means includes mating ball and socket surfaces.

36. The apparatus of claim 34 including asymmetric drag means coupled to said rigid tube.

37. The apparatus of claim 32 including a substantially closed housing having an opening formed therein; and wherein said conduit means is mounted in said housing for movement of said discharge orifice along said substnatially planar area in said housing opening.

38. The apparatus of claim 37 in combination with a spa tub or the like having a perimeter wall defining an interior wall surface and an exterior wall surface;

an opening formed in said perimeter wall; and wherein said housing is mounted in said wall opening extending exteriorly with respect to said perimter wall and with said housing opening and said wall opening being substantially coincident.

39. The combination of claim 38 including a suction port formed in said perimeter wall; and recirculation means for drawing water in through said suction port and for supplying water to said fluid supply means.

* * * * *